US007100713B2

(12) United States Patent
Tulloch

(10) Patent No.: US 7,100,713 B2
(45) Date of Patent: Sep. 5, 2006

(54) EXPANDABLE APPARATUS FOR DRIFT AND REAMING BOREHOLE

(75) Inventor: Rory McCrae Tulloch, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 35 days.

(21) Appl. No.: 10/258,375

(22) PCT Filed: Apr. 2, 2001

(86) PCT No.: PCT/GB01/01512

§ 371 (c)(1),
(2), (4) Date: Mar. 5, 2003

(87) PCT Pub. No.: WO01/83932

PCT Pub. Date: Nov. 8, 2001

(65) Prior Publication Data

US 2003/0164251 A1 Sep. 4, 2003

(30) Foreign Application Priority Data

Apr. 28, 2000 (GB) ..... 0010378.8

(51) Int. Cl.
*E21B 17/14* (2006.01)
*E21B 10/32* (2006.01)

(52) U.S. Cl. ..... 175/402; 175/268; 166/242.8

(58) Field of Classification Search ..... 175/402, 175/406, 268, 286, 288, 270; 166/242.8
See application file for complete search history.

(56) References Cited

U.S. PATENT DOCUMENTS 1,185,582 A 5/1916 Bignell
1,301,285 A 4/1919 Leonard
1,342,424 A 6/1920 Cotten
1,842,638 A 1/1932 Wigle
1,880,218 A 10/1932 Simmons
1,917,135 A 7/1933 Littell
1,981,525 A 11/1934 Price
2,017,451 A 10/1935 Wickersham
2,049,450 A 8/1936 Johnson
2,060,352 A 11/1936 Stokes
2,167,338 A 7/1939 Murcell
2,214,429 A 9/1940 Miller
2,216,895 A 10/1940 Stokes
2,228,503 A 1/1941 Boyd et al.
2,295,803 A * 9/1942 O'Leary ..... 175/318
2,324,679 A 7/1943 Cox
2,370,832 A 3/1945 Baker (Continued)

FOREIGN PATENT DOCUMENTS

CA 2 335 192 11/2001

(Continued)

OTHER PUBLICATIONS

PCT International Search Report dated Jul. 19, 2001, for application Ser. No. PCT/GB01/01512.

(Continued)

*Primary Examiner*—David Bagnell
*Assistant Examiner*—Giovanna M. Collins
(74) *Attorney, Agent, or Firm*—Patterson & Sheridan, LLP

(57) ABSTRACT

An expandable reamer shoe is provided for use with expandable casing in a borehole. The reamer shoe has a number of reaming members in the form of blades which remain closed against the body of the shoe when inserted through casing, and can then be expanded to underream below the casing. Additionally, the expandable reamer shoe is made substantially of a drillable material so that the borehole can be extended beyond the point reached by the expandable reamer shoe.

67 Claims, 7 Drawing Sheets

U.S. PATENT DOCUMENTS

Figure 1A:
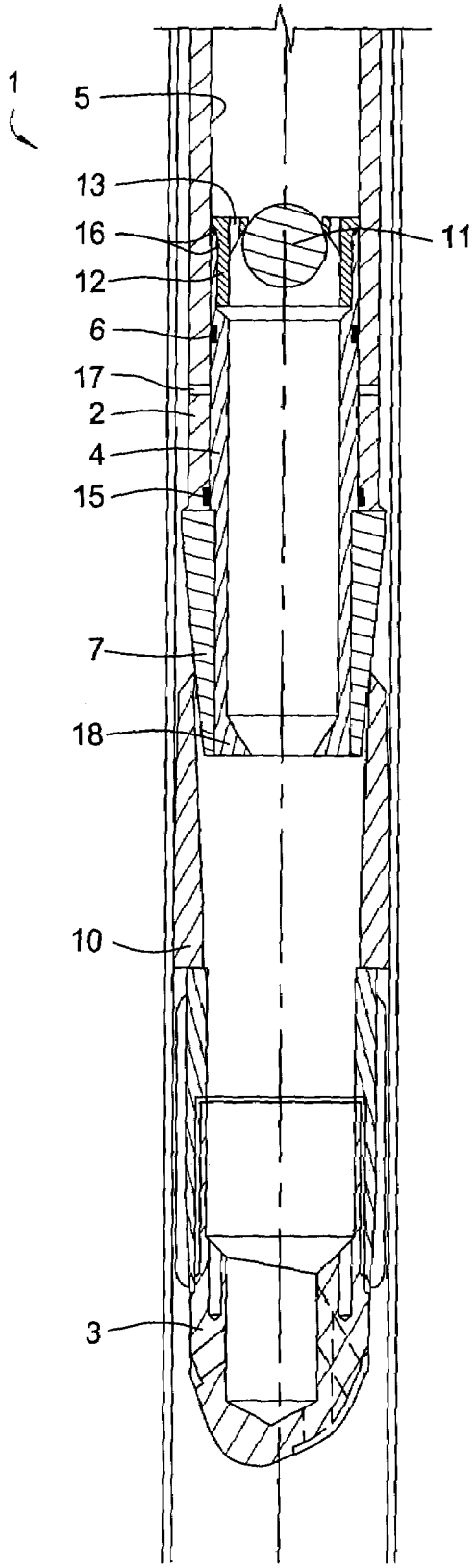

| | | | | |
|---|---|---|---|---|
| 2,379,800 | A | | 7/1945 | Hare |
| 2,414,719 | A | | 1/1947 | Cloud |
| 2,499,630 | A | | 3/1950 | Clark |
| 2,522,444 | A | | 9/1950 | Grable |
| 2,610,690 | A | | 9/1952 | Beatty |
| 2,621,742 | A | | 12/1952 | Brown |
| 2,627,891 | A | | 2/1953 | Clark |
| 2,641,444 | A | | 6/1953 | Moon |
| 2,650,314 | A | | 8/1953 | Hennigh et al. |
| 2,663,073 | A | | 12/1953 | Bieber et al. |
| 2,668,689 | A | | 2/1954 | Cormany |
| 2,692,059 | A | | 10/1954 | Bolling, Jr. |
| 2,720,267 | A | | 10/1955 | Brown |
| 2,738,011 | A | | 3/1956 | Mabry |
| 2,741,907 | A | | 4/1956 | Genender et al. |
| 2,743,087 | A | | 4/1956 | Layne et al. |
| 2,743,495 | A | | 5/1956 | Eklund |
| 2,764,329 | A | | 9/1956 | Hampton |
| 2,765,146 | A | | 10/1956 | Williams |
| 2,805,043 | A | | 9/1957 | Williams |
| 2,978,047 | A | | 4/1961 | DeVaan |
| 3,006,415 | A | | 10/1961 | Burns et al. |
| 3,041,901 | A | | 7/1962 | Knights |
| 3,054,100 | A | | 9/1962 | Jones |
| 3,087,546 | A | | 4/1963 | Wooley |
| 3,090,031 | A | | 5/1963 | Lord |
| 3,102,599 | A | | 9/1963 | Hillburn |
| 3,111,179 | A | | 11/1963 | Albers et al. |
| 3,117,636 | A | | 1/1964 | Wilcox et al. |
| 3,122,811 | A | | 3/1964 | Gilreath |
| 3,123,160 | A | | 3/1964 | Kammerer |
| 3,124,023 | A | | 3/1964 | Marquis et al. |
| 3,131,769 | A | | 5/1964 | Rochemont |
| 3,159,219 | A | | 12/1964 | Scott |
| 3,169,592 | A | | 2/1965 | Kammerer |
| 3,191,677 | A | | 6/1965 | Kinley |
| 3,191,680 | A | | 6/1965 | Vincent |
| 3,193,116 | A | | 7/1965 | Kenneday et al. |
| 3,353,599 | A | | 11/1967 | Swift |
| 3,380,528 | A | | 4/1968 | Timmons |
| 3,387,893 | A | | 6/1968 | Hoever |
| 3,392,609 | A | | 7/1968 | Bartos |
| 3,419,079 | A | | 12/1968 | Current |
| 3,433,313 | A | * | 3/1969 | Brown ..... 175/270 |
| 3,489,220 | A | | 1/1970 | Kinley |
| 3,518,903 | A | | 7/1970 | Ham et al. |
| 3,548,936 | A | | 12/1970 | Kilgore et al. |
| 3,550,684 | A | | 12/1970 | Cubberly, Jr. |
| 3,552,507 | A | | 1/1971 | Brown |
| 3,552,508 | A | | 1/1971 | Brown |
| 3,552,509 | A | | 1/1971 | Brown |
| 3,552,510 | A | | 1/1971 | Brown ..... 175/261 |
| 3,552,848 | A | | 1/1971 | Van Wagner |
| 3,559,739 | A | | 2/1971 | Hutchison |
| 3,566,505 | A | | 3/1971 | Martin |
| 3,570,598 | A | | 3/1971 | Johnson |
| 3,575,245 | A | | 4/1971 | Cordary et al. |
| 3,602,302 | A | | 8/1971 | Kluth |
| 3,603,411 | A | | 9/1971 | Link |
| 3,603,412 | A | | 9/1971 | Kammerer, Jr. et al. |
| 3,603,413 | A | | 9/1971 | Grill et al. |
| 3,606,664 | A | | 9/1971 | Weiner |
| 3,624,760 | A | | 11/1971 | Bodine |
| 3,635,105 | A | | 1/1972 | Dickmann et al. |
| 3,656,564 | A | | 4/1972 | Brown |
| 3,669,190 | A | | 6/1972 | Sizer et al. |
| 3,680,412 | A | | 8/1972 | Mayer et al. |
| 3,691,624 | A | | 9/1972 | Kinley |
| 3,691,825 | A | | 9/1972 | Dyer |
| 3,692,126 | A | | 9/1972 | Rushing et al. |
| 3,696,332 | A | | 10/1972 | Dickson, Jr. et al. |
| 3,700,048 | A | | 10/1972 | Desmoulins |
| 3,729,057 | A | | 4/1973 | Werner |
| 3,747,675 | A | | 7/1973 | Brown |
| 3,760,894 | A | | 9/1973 | Pitifer |
| 3,776,320 | A | | 12/1973 | Brown |
| 3,776,991 | A | | 12/1973 | Marcus |
| 3,785,193 | A | | 1/1974 | Kinley et al. |
| 3,808,916 | A | | 5/1974 | Porter et al. |
| 3,838,613 | A | | 10/1974 | Wilms |
| 3,840,128 | A | | 10/1974 | Swoboda, Jr. et al. |
| 3,848,684 | A | | 11/1974 | West |
| 3,857,450 | A | | 12/1974 | Guier |
| 3,870,114 | A | | 3/1975 | Pulk et al. |
| 3,881,375 | A | | 5/1975 | Kelly |
| 3,885,679 | A | | 5/1975 | Swoboda, Jr. et al. |
| 3,901,331 | A | | 8/1975 | Djurovic |
| 3,913,687 | A | | 10/1975 | Gyongyosi et al. |
| 3,934,660 | A | | 1/1976 | Nelson |
| 3,945,444 | A | | 3/1976 | Knudson |
| 3,964,556 | A | | 6/1976 | Gearhart et al. |
| 3,980,143 | A | | 9/1976 | Swartz et al. |
| 4,049,066 | A | | 9/1977 | Richey |
| 4,054,332 | A | | 10/1977 | Bryan, Jr. |
| 4,054,426 | A | | 10/1977 | White |
| 4,064,939 | A | | 12/1977 | Marquis |
| 4,077,525 | A | | 3/1978 | Callegari et al. |
| 4,082,144 | A | | 4/1978 | Marquis |
| 4,083,405 | A | | 4/1978 | Shirley |
| 4,085,808 | A | | 4/1978 | Kling |
| 4,095,865 | A | | 6/1978 | Denison et al. |
| 4,100,968 | A | | 7/1978 | Delano |
| 4,100,981 | A | | 7/1978 | Chaffin |
| 4,127,927 | A | | 12/1978 | Hauk et al. |
| 4,133,396 | A | | 1/1979 | Tschirky |
| 4,142,739 | A | | 3/1979 | Billingsley |
| 4,173,457 | A | | 11/1979 | Smith |
| 4,175,619 | A | | 11/1979 | Davis |
| 4,186,628 | A | | 2/1980 | Bonnice |
| 4,189,185 | A | | 2/1980 | Kammerer, Jr. et al. |
| 4,194,383 | A | | 3/1980 | Huzyak |
| 4,221,269 | A | | 9/1980 | Hudson |
| 4,227,197 | A | | 10/1980 | Nimmo et al. |
| 4,241,878 | A | | 12/1980 | Underwood |
| 4,257,442 | A | | 3/1981 | Claycomb |
| 4,262,693 | A | | 4/1981 | Giebeler |
| 4,274,777 | A | | 6/1981 | Scaggs |
| 4,274,778 | A | | 6/1981 | Putnam et al. |
| 4,277,197 | A | | 7/1981 | Bingham |
| 4,280,380 | A | | 7/1981 | Eshghy |
| 4,281,722 | A | | 8/1981 | Tucker et al. |
| 4,287,949 | A | | 9/1981 | Lindsey, Jr. |
| 4,311,195 | A | | 1/1982 | Mullins, II |
| 4,315,553 | A | | 2/1982 | Stallings |
| 4,320,915 | A | | 3/1982 | Abbott et al. |
| 4,336,415 | A | | 6/1982 | Walling |
| 4,384,627 | A | | 5/1983 | Ramirez-Jauregui |
| 4,392,534 | A | | 7/1983 | Miida |
| 4,396,076 | A | | 8/1983 | Inoue |
| 4,396,077 | A | | 8/1983 | Radtke |
| 4,407,378 | A | | 10/1983 | Thomas |
| 4,408,669 | A | | 10/1983 | Wiredal |
| 4,413,682 | A | | 11/1983 | Callihan et al. |
| 4,427,063 | A | | 1/1984 | Skinner |
| 4,437,363 | A | | 3/1984 | Haynes |
| 4,440,220 | A | | 4/1984 | McArthur |
| 4,445,734 | A | | 5/1984 | Cunningham |
| 4,446,745 | A | | 5/1984 | Stone et al. |
| 4,449,596 | A | | 5/1984 | Boyadjieff |
| 4,460,053 | A | | 7/1984 | Jurgens et al. |
| 4,463,814 | A | | 8/1984 | Horstmeyer et al. |
| 4,466,498 | A | | 8/1984 | Bardwell |
| 4,470,470 | A | | 9/1984 | Takano |
| 4,472,002 | A | | 9/1984 | Beney et al. |

4,474,243 A 10/1984 Gaines
4,483,399 A 11/1984 Colgate
4,489,793 A 12/1984 Boren
4,494,424 A 1/1985 Bates
4,515,045 A 5/1985 Gnatchenko et al.
4,529,045 A 7/1985 Boyadjieff et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,773 A 6/1986 Skeie
4,595,058 A 6/1986 Nations
4,603,749 A * 8/1986 Davis et al. ..... 175/250
4,604,724 A 8/1986 Shaginian et al.
4,604,818 A 8/1986 Inoue
4,605,077 A 8/1986 Boyadjieff
4,605,268 A 8/1986 Meador
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,312 A 6/1987 Mosing et al.
4,681,158 A 7/1987 Pennison
4,683,962 A 8/1987 True
4,686,873 A 8/1987 Lang et al.
4,691,587 A 9/1987 Farrand et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,901,069 A 2/1990 Veneruso
4,904,119 A 2/1990 Legendre et al.
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,069,297 A 12/1991 Krueger
5,074,366 A 12/1991 Karlsson et al.
5,082,069 A 1/1992 Seiler et al.
5,096,465 A 3/1992 Chen et al.
5,109,924 A 5/1992 Jurgens et al.
5,111,893 A 5/1992 Kvello-Aune
5,127,482 A * 7/1992 Rector, Jr. ..... 175/321
5,141,063 A 8/1992 Quesenbury
RE34,063 E 9/1992 Vincent et al.
5,148,875 A 9/1992 Karlsson et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A * 3/1993 Leturno ..... 175/57
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,282,653 A 2/1994 LaFleur et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,343,950 A 9/1994 Hale et al.
5,343,951 A 9/1994 Cowan et al.
5,348,095 A * 9/1994 Worrall et al. ..... 166/380
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts ..... 175/286
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,394,823 A 3/1995 Lenze
5,402,856 A 4/1995 Warren et al.
5,433,279 A 7/1995 Tassari et al.
5,435,400 A 7/1995 Smith
5,452,923 A 9/1995 Smith
5,456,317 A 10/1995 Hood, III et al.

5,458,209 A 10/1995 Hayes et al.
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,575,344 A 11/1996 Wireman
5,577,566 A 11/1996 Albright et al.
5,582,259 A 12/1996 Barr
5,584,343 A 12/1996 Coone
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,023 A 9/1997 Harrell et al.
5,667,026 A 9/1997 Lorenz et al.
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,732,776 A 3/1998 Tubel et al.
5,735,348 A 4/1998 Hawkins, III
5,743,344 A 4/1998 McLeod et al.
5,746,276 A 5/1998 Stuart
5,785,132 A 7/1998 Richardson et al.
5,785,134 A 7/1998 McLeod et al.
5,787,978 A 8/1998 Carter et al.
5,791,410 A 8/1998 Castille et al.
5,803,191 A 9/1998 Mackintosh
5,803,666 A 9/1998 Keller
5,813,456 A 9/1998 Milner et al.
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,947,214 A * 9/1999 Tibbitts ..... 175/276
5,950,742 A 9/1999 Caraway
5,957,225 A 9/1999 Sinor
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A * 5/2000 Strong et al. ..... 175/402
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,343,649 B1 2/2002 Beck et al.
6,349,764 B1 2/2002 Adams et al.
6,357,485 B1 3/2002 Quigley et al.
6,359,569 B1 3/2002 Beck et al.
6,360,633 B1 3/2002 Pietras
6,367,566 B1 4/2002 Hill
6,371,203 B1 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,392,317 B1 5/2002 Hall et al.
6,397,946 B1 6/2002 Vail, III
6,405,798 B1 6/2002 Barrett et al.

6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,446,723 B1 9/2002 Ramons et al.
6,457,532 B1 10/2002 Simpson
6,458,471 B1 10/2002 Lovato et al.
6,464,004 B1 10/2002 Crawford et al.
6,464,011 B1 10/2002 Tubel
6,484,818 B1 11/2002 Alft et al.
6,497,280 B1 12/2002 Beck et al.
6,527,047 B1 3/2003 Pietras
6,527,064 B1 3/2003 Hallundbaek
6,536,520 B1 3/2003 Snider et al.
6,536,522 B1 3/2003 Birckhead et al.
6,536,993 B1 3/2003 Strong et al.
6,538,576 B1 3/2003 Schultz et al.
6,543,552 B1 4/2003 Melcalfe et al.
6,547,017 B1 4/2003 Vail, III
6,554,064 B1 4/2003 Restarick et al.
6,585,040 B1 7/2003 Hanton et al.
6,591,471 B1 7/2003 Hollingsworth et al.
6,622,796 B1 9/2003 Pietras
6,634,430 B1 10/2003 Dawson et al.
6,648,075 B1 11/2003 Badrak et al.
6,651,737 B1 11/2003 Bouligny
6,655,460 B1 12/2003 Bailey et al.
6,666,274 B1 12/2003 Hughes
6,668,684 B1 12/2003 Allen et al.
6,668,937 B1 12/2003 Murray
6,688,394 B1 2/2004 Ayling
6,691,801 B1 2/2004 Juhasz et al.
6,698,595 B1 3/2004 Norell et al.
6,702,030 B1 * 3/2004 Simpson ..... 166/380
6,702,040 B1 3/2004 Sensenig
6,708,769 B1 3/2004 Haugen et al.
6,725,924 B1 4/2004 Davidson et al.
6,725,938 B1 4/2004 Pietras
6,742,596 B1 6/2004 Haugen
6,742,606 B1 6/2004 Melcalfe et al.
6,745,834 B1 6/2004 Davis et al.
6,752,211 B1 6/2004 Dewey et al.
6,840,322 B1 1/2005 Haynes
6,848,517 B1 2/2005 Wardley
6,854,533 B1 2/2005 Galloway
6,857,486 B1 2/2005 Chitwood et al.
6,857,487 B1 2/2005 Galloway et al.
2001/0000101 A1 4/2001 Lovato et al.
2001/0002626 A1 6/2001 Frank et al.
2001/0013412 A1 8/2001 Tubel
2001/0040054 A1 11/2001 Haugen et al.
2001/0042625 A1 11/2001 Appleton
2001/0047883 A1 12/2001 Hanton et al.
2002/0040787 A1 4/2002 Cook et al.
2002/0066556 A1 6/2002 Goode et al.
2002/0074127 A1 6/2002 Birckhead et al.
2002/0074132 A1 6/2002 Juhasz et al.
2002/0079102 A1 6/2002 Dewey et al.
2002/0108748 A1 8/2002 Keyes
2002/0134555 A1 9/2002 Allen et al.
2002/0157829 A1 10/2002 Davis et al.
2002/0162690 A1 11/2002 Hanton et al.
2002/0189806 A1 12/2002 Davidson et al.
2002/0189863 A1 12/2002 Wardley
2003/0029641 A1 2/2003 Meehan
2003/0034177 A1 2/2003 Chitwood et al.
2003/0056947 A1 3/2003 Cameron
2003/0056991 A1 3/2003 Hahn et al.
2003/0070841 A1 4/2003 Merecka et al.
2003/0070842 A1 4/2003 Bailey et al.
2003/0111267 A1 6/2003 Pia
2003/0141111 A1 7/2003 Pia
2003/0146023 A1 8/2003 Pia
2003/0164250 A1 9/2003 Wardley
2003/0164251 A1 9/2003 Tulloch
2003/0173090 A1 9/2003 Cook et al.
2003/0213598 A1 11/2003 Hughes
2003/0217865 A1 11/2003 Simpson et al.
2003/0221519 A1 12/2003 Haugen et al.
2004/0000405 A1 1/2004 Fournier, Jr. et al.
2004/0003490 A1 1/2004 Shahin et al.
2004/0003944 A1 1/2004 Vincent et al.
2004/0011534 A1 1/2004 Simonds et al.
2004/0016575 A1 1/2004 Shahin et al.
2004/0060697 A1 4/2004 Tilton et al.
2004/0069500 A1 4/2004 Haugen
2004/0069501 A1 4/2004 Haugen et al.
2004/0079533 A1 4/2004 Buytaert et al.
2004/0108142 A1 6/2004 Vail, III
2004/0112603 A1 6/2004 Galloway et al.
2004/0112646 A1 6/2004 Vail
2004/0118613 A1 6/2004 Vail
2004/0118614 A1 6/2004 Galloway et al.
2004/0123984 A1 7/2004 Vail
2004/0124010 A1 7/2004 Galloway et al.
2004/0124011 A1 7/2004 Gledhill et al.
2004/0124015 A1 7/2004 Vaile et al.
2004/0129456 A1 7/2004 Vail
2004/0140128 A1 7/2004 Vail
2004/0173358 A1 9/2004 Haugen
2004/0216892 A1 11/2004 Giroux et al.
2004/0216924 A1 11/2004 Pietras et al.
2004/0216925 A1 11/2004 Metcalfe et al.
2004/0221997 A1 11/2004 Giroux et al.
2004/0226751 A1 11/2004 McKay et al.
2004/0244992 A1 12/2004 Carter et al.
2004/0245020 A1 12/2004 Giroux et al.
2004/0251025 A1 12/2004 Giroux et al.
2004/0251050 A1 12/2004 Shahin et al.
2004/0251055 A1 12/2004 Shahin et al.
2004/0262013 A1 12/2004 Tilton et al.
2005/0000691 A1 1/2005 Giroux et al.

FOREIGN PATENT DOCUMENTS

DE 3 213 464 10/1983
DE 3 523 221 2/1987
DE 3 918 132 12/1989
DE 4 133 802 10/1992
EP 0 087 373 8/1983
EP 0 162 000 11/1985
EP 0 171 144 2/1986
EP 0 235 105 9/1987
EP 0 265 344 4/1988
EP 0 285 386 10/1988
EP 0 426 123 5/1991
EP 0 462 618 12/1991
EP 0 474 481 3/1992
EP 0 525 247 2/1993
EP 0 554 568 8/1993
EP 0 589 823 3/1994
EP 0 659 975 6/1995
EP 0 790 386 8/1997
EP 0 881 354 4/1998
EP 0 571 045 8/1998
EP 0 961 007 12/1999
EP 0 962 384 12/1999
EP 1 006 260 6/2000
EP 1 050 661 11/2000
EP 1 256 691 11/2002

| | | |
|---|---|---|
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 201 912 | 9/1988 |
| GB | 2 216 926 | 10/1989 |
| GB | 2 224 481 | 9/1990 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 333 542 | 7/1999 |
| GB | 2333542 | 7/1999 |
| GB | 2 335 217 | 9/1999 |
| GB | 2 348 223 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 765 | 9/2002 |
| GB | 2 382 361 | 5/2003 |
| RU | 2 079 633 | 5/1997 |
| SU | 112631 | 1/1956 |
| SU | 659260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| SU | 1618870 | 1/1991 |
| SU | 1808972 | 5/1991 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/24728 | 12/1993 |
| WO | WO 95/10686 | 4/1995 |
| WO | WO 96/18799 | 6/1996 |
| WO | WO 96/28635 | 9/1996 |
| WO | WO96/28635 | 9/1996 |
| WO | WO 97/08418 | 3/1997 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/11902 | 3/1999 |
| WO | WO 99/23354 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | 11/1999 |
| WO | WO99/64713 | 12/1999 |
| WO | WO 99/64713 | 12/1999 |
| WO | WO 00/05483 | 2/2000 |
| WO | WO 00/08293 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/39429 | 7/2000 |
| WO | WO 00/39430 | 7/2000 |
| WO | WO 00/46484 | 8/2000 |
| WO | WO 00/50730 | 8/2000 |
| WO | WO 00/66879 | 11/2000 |
| WO | WO 01/12946 | 2/2001 |
| WO | WO 01/46550 | 6/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/44601 | 6/2002 |
| WO | WO 02/081863 | 10/2002 |
| WO | WO 02/086287 | 10/2002 |
| WO | WO 03/087525 | 10/2003 |

OTHER PUBLICATIONS

Hahn, et al., "Simultaneous Drill and Case Technology—Case Histories, Status and Options for Further Development," Society of Petroleum Engineers, IADC/SPE Drilling Conference, New Orleans, LA Feb. 23-25, 2000 pp. 1-9.

M.B. Stone and J. Smith, "Expandable Tubulars and Casing Drilling are Options" Drilling Contractor, Jan./Feb. 2002, pp. 52.

M. Gelfgat, "Retractable Bits Development and Application" Transactions of the ASME, vol. 120, Jun. (1998), pp. 124-130.

"First Success with Casing-Drilling" Word Oil, Feb. (1999), pp. 25.

Dean E. Gaddy, Editor, "Russia Shares Technical Know-How with U.S." Oil & Gas Journal, Mar. (1999), pp. 51-52 and 54-56.

U.S. Appl. No. 10/794,800, filed Mar. 5, 2004 (WEAT/0360).

U.S. Appl. No. 10/832,804, filed Apr. 27, 2004 (WEAT/0383.P1).

U.S. Appl. No. 10/795,214, filed Mar. 5, 2004 (WEAT/0373).

U.S. Appl. No. 10/794,795, filed Mar. 5, 2004 (WEAT/0357).

U.S. Appl. No. 10/775,048, filed Feb. 9, 2004 (WEAT/0359).

U.S. Appl. No. 10/772,217, filed Feb. 2, 2004 (WEAT/0344).

U.S. Appl. No. 10/788,976, filed Feb. 27, 2004 (WEAT/0372).

U.S. Appl. No. 10/794,797, filed Mar. 5, 2004 (WEAT/0371).

U.S. Appl. No. 10/767,322, filed Jan. 29, 2004 (WEAT/0343).

U.S. Appl. No. 10/795,129, filed Mar. 5, 2004 (WEAT/0366).

U.S. Appl. No. 10/794,790, filed Mar. 5, 2004 (WEAT/0329).

U.S. Appl. No. 10/162,302, filed Jun. 4, 2004 (WEAT/0410).

Rotary Steerable Technology—Technology Gains Momentum, Oil & Gas Journal, Dec. 28, 1998.

Directional Drilling, M. Mims, World Oil, May 1999, pp. 40-43.

Multilateral Classification System w/Example Applications, Alan MacKenzie & Cliff Hogg, World Oil, Jan. 1999, pp. 55-61.

U.S. Appl. No. 10/618,093.

U.S. Appl. No. 10/189,570.

Tarr, et al., "Casing-while-Drilling: The Next Step Change In Well Construction," World Oil, Oct. 1999, pp. 34-40.

De Leon Mojarro, "Breaking A Paradigm: Drilling With Tubing Gas Wells," SPE Paper 40051, SPE Annual Technical Conference And Exhibition, Mar. 3-5, 1998, pp. 465-472.

De Leon Mojarro, "Drilling/Completing With Tubing Cuts Well Costs By 30%," World Oil, Jul. 1998, pp. 145-150.

Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr., 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving The Marked?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANRIG Drilling Technology, Ltd., Sep. 18, 1996.

* cited by examiner

EXPANDABLE APPARATUS FOR DRIFT AND REAMING BOREHOLE

This invention relates to an expandable reamer shoe which can be used to drift and ream drilled well bores, as are typically used in oil and gas production.

When constructing a well bore, it is standard practice to drill in intervals. Firstly, a large surface hole is created into which casing is installed to act as a lining in the bore. Cement can then be placed between the external surface of the casing and the interior of the well bore in order to structurally support the casing. In order to drill the next and deeper section of the bore it is common practice to use a smaller drill bit attached to a drill string which can be lowered through the previously installed casing in the first section of the bore. Consequently, the next section of the bore, and the casing installed within it, has a smaller diameter to that which is above it. Further sections of well are then lined with a length of even smaller casing which runs back to the surface and is inserted into the bore by the above described method. Several sections of hole may be drilled before the final section, near the production zone, is drilled and lined with liner, which is hung inside the bore on the last string of casing, rather than being run back to the surface like the casing sections above it.

There have been a number of methods recently described whereby steel casing (U.S. Pat. No. 5,667,011 and WO 93/25799) can be expanded after it has been run into a bore. Expandable casing overcomes the problem inherent to conventional casing whereby as a consequence of the normal installation procedure, the diameter of the sections of casing decreases with depth in the well-bore. However, if the well bore is not at the planned diameter when the casing is expanded in the hole which may occur for example, due to hole contraction after the drilling run, there is a danger that the next string of casing when expanded, will not go out to the full size, due to the restricted hole diameter outside the casing.

When required to drill a hole below the casing, of a size larger than the bore of the casing, it is standard practice to use a drill string with an underreamer and pilot bit. Underreamers are comprised of a plurality of expandable arms which can move between a closed position and an open position. The underreamer can be passed through the casing, behind the pilot bit when the underreamer is closed. After passing through the casing the underreamer can be opened in order to enlarge the hole below the casing. It is not feasible when running expandable casing, to drill down the casing using an underreamer attached, as underreamers are not drillable, that is they can only be used when there is a certainty that further sections of the bore will not be drilled, as the subsequent drill bit or casing drill shoe would have to pass through the underreamer in order to advance. This is extremely difficult as underreamers are required to ream and remove hard rock material and typically comprise hard, resilient materials such as Tungsten Carbide or steel. Drilling through an in-place underreamer may result in damaging the drill bit or the casing drill shoe, adversely affecting the efficiency of any further drilling.

Other methods include the use of an expandable bit, rather than an underreamer with a pilot solid crown bit, and also a bi-centre bit.

It is therefore recognised in the present invention that it would be advantageous to provide a reamer shoe which can be used in conjunction with expandable casing and which is itself expandable, and can drift and ream a drilled section prior to expansion of the casing.

It is an object of the present invention to provide an expandable reamer shoe which can be attached to casing and which can drift and/or ream a previously drilled hole regardless of whether the casing is being advanced by rotation and/or reciprocation of the reamer shoe.

It is further object of the present invention to provide an expandable reamer shoe which can be used with either expandable casing or standard casing when desired.

It is a yet further object of the present invention to provide an expandable reamer which is constructed from a material which allows a casing drill shoe or drill bit to drill through it such that the drill shoe or drill bit is not damaged and can progress beyond the point reached by the expandable reamer shoe within the well bore.

According to a first aspect of the present invention there is provided a reamer shoe for mounting on a casing string, the reamer shoe having a plurality of reaming members wherein said reamer shoe is constructed from a relatively soft drillable material, wherein the plurality of reaming members are moveable between a first and second position, and wherein the reaming members are closed in the first position and expanded in the second position.

Optionally the expandable reamer shoe can act as a drift.

Preferably the plurality of reaming members are in the form of blades.

Optionally each of the blades has a hard facing applied to the outer surface.

In one embodiment, the reaming members move from the first closed position to the second expanded position by virtue of the movement of an activating piston.

Most preferably said activating piston defines an internal bore.

Preferably movement of the activating piston is provided by an increase in hydrostatic pressure.

Preferably the increase in hydrostatic pressure is provided by an obstructing means within the internal bore of the activating piston.

Most preferably said obstructing means is a deformable ball or dart.

Preferably the reaming members are fully expanded when the ball communicates with a seat formation in the internal bore.

Preferably the ball is held inside the bore of the activating piston by a retainer ring.

Preferably the retainer ring has a plurality of by-pass ports which allow fluid and mud to pass through the retainer ring.

Optionally the activating piston or retainer ring is adapted to receive a retrieval tool such as a spear or overshot.

Preferably the activating piston has an external split ring mounted around the outside diameter.

Preferably the split ring can communicate with a groove in the body of the reamer shoe, wherein the activating piston is prevented from moving when the split ring is in communication with said groove.

Preferably a plurality of ramps are located externally to the activating piston.

Preferably the activating piston ramp segments, split ring, ball, retainer ring and float valve are drillable.

In a second embodiment concept of the present invention, the reaming members move from the first closed position to the second expanded position by virtue of a hydrodynamic pressure drop between the interior and exterior of the reamer shoe.

Most preferably said hydrodynamic pressure drop is created by one or more nozzles which may be attached to the lowermost end of the reamer shoe.

Preferably the reaming members are held in the first closed position by a plurality of leaf springs.

Preferably in the second expanded position the reaming members are locked in position by a first and second retaining block at either end.

Optionally the reamer shoe may contain a rupture means such as a burst disc, wherein upon rupturing, the rupture means permits the flow area of fluid from the interior of the reamer shoe to the exterior to be increased for ease of passage of cement, when cementing the casing, after reaming to bottom.

Optionally the expandable reamer shoe may have a cementing float valve fitted in the nose or the bore of the body.

According to a second aspect of the present invention there is provided a method of inserting expandable casing into a borehole, comprising the steps of;

a) running a first section of expandable casing into a pre-drilled borehole, expanding and then cementing (if required) the expandable casing in place,
b) underreaming under the in-place casing using a standard underreamer and pilot bit or an expandable bit or bi-centre bit,
c) running a second length of expandable casing through the in-place casing with an expandable reamer shoe to ream down by rotation and/or reciprocation to guarantee the hole is at the expected size
d) After reaming down, if needed, the expandable casing can be expanded and then cemented (if required) to create a slimhole or even a mono-bore well. The expandable reamer shoe, as well as having expandable blades, can also be designed to have its body expanded in the same manner as the casing above it.

The method may further comprise the step of running a subsequent section of casing through the in-place section of expandable casing after drilling through the apparatus of the first aspect to create a new hole or even to use a casing drill shoe to drill out the nose of the expandable reamer shoe for drilling and casing simultaneously.

Figure 1B:
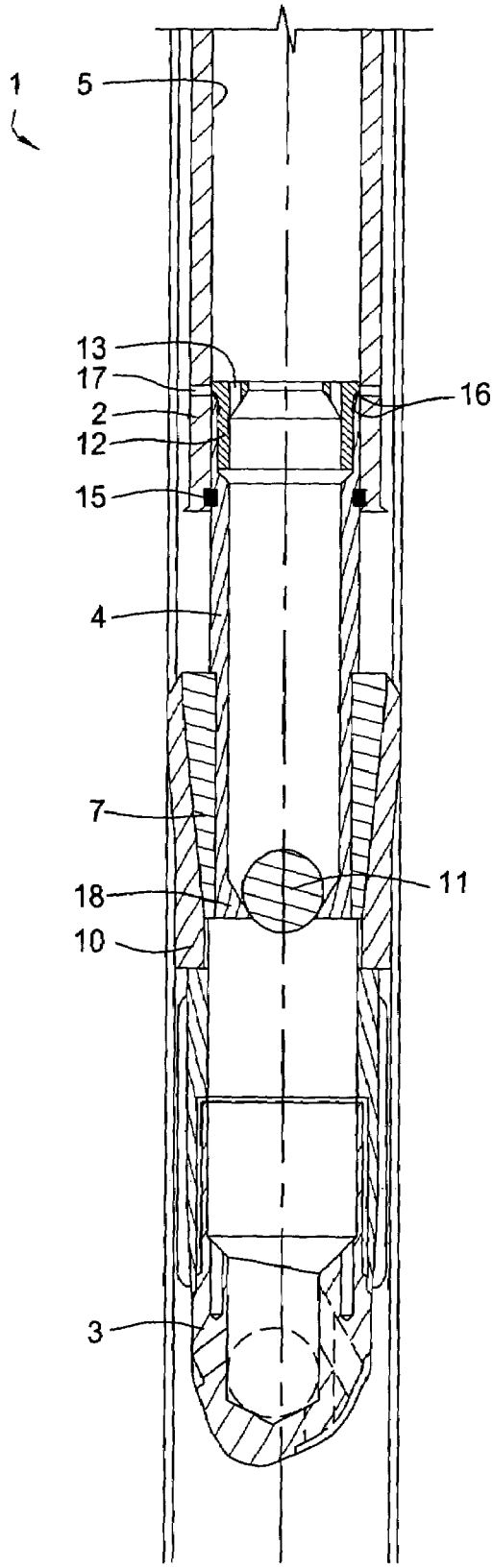
Figure 2:
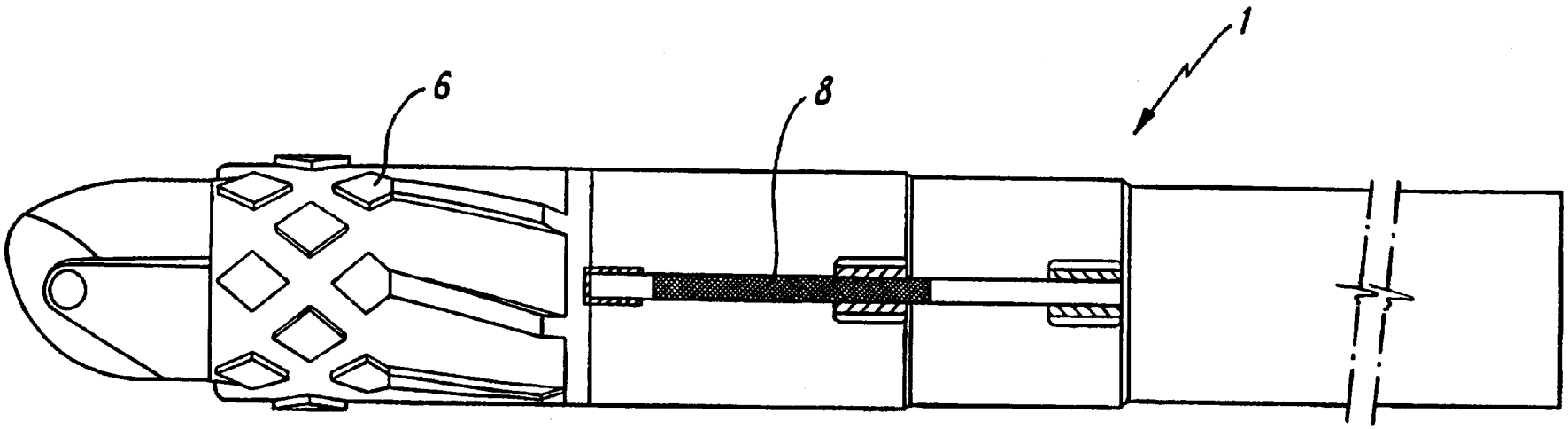
Figure 3:
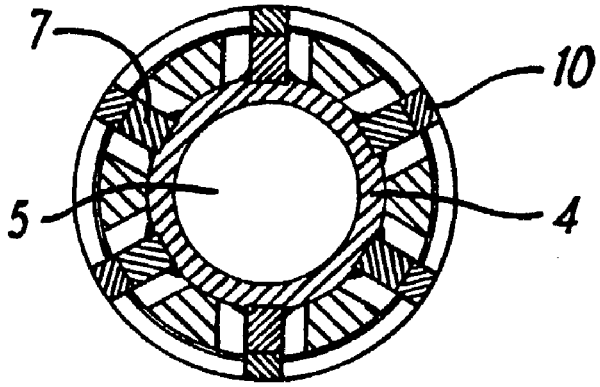
Figure 4:
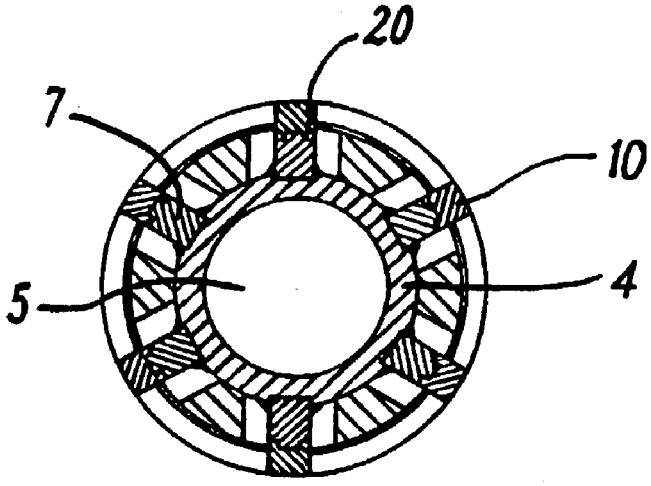
Figure 5:
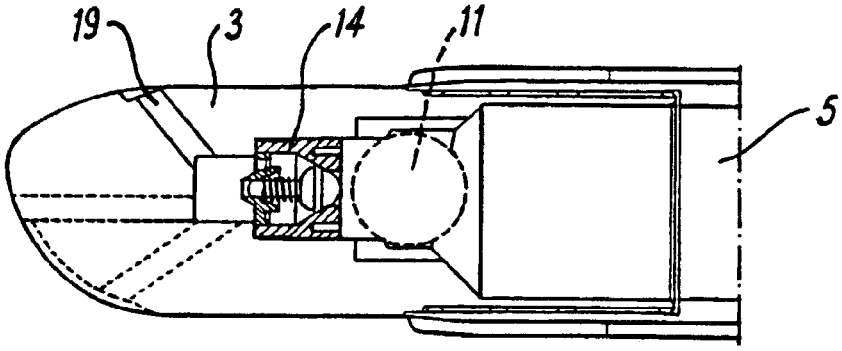
Figure 6:
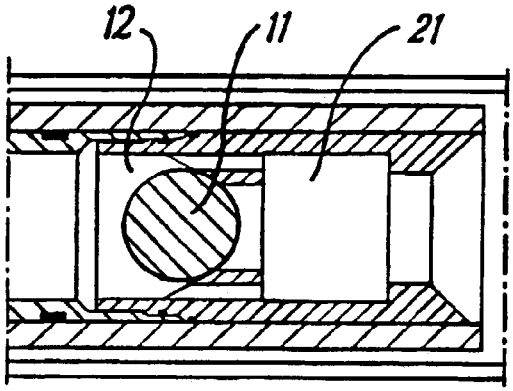
Figure 7:
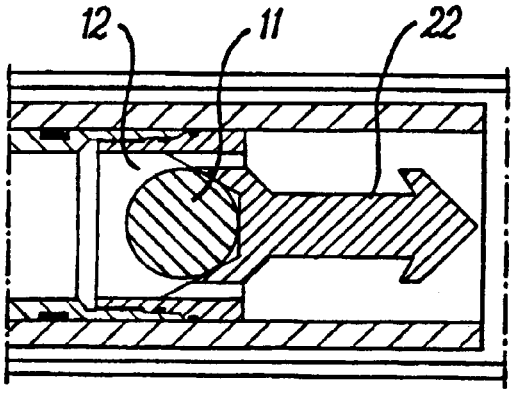
Figure 8:
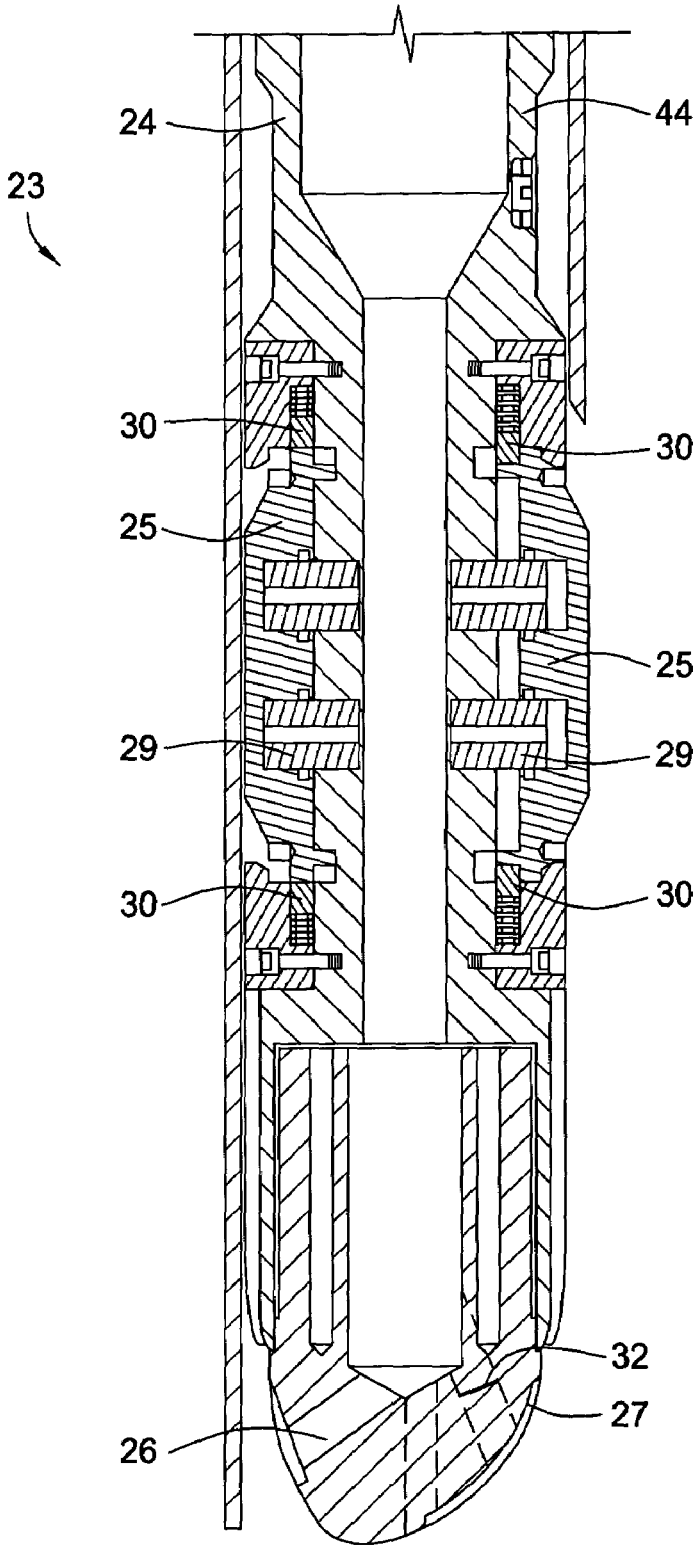
Figure 9:
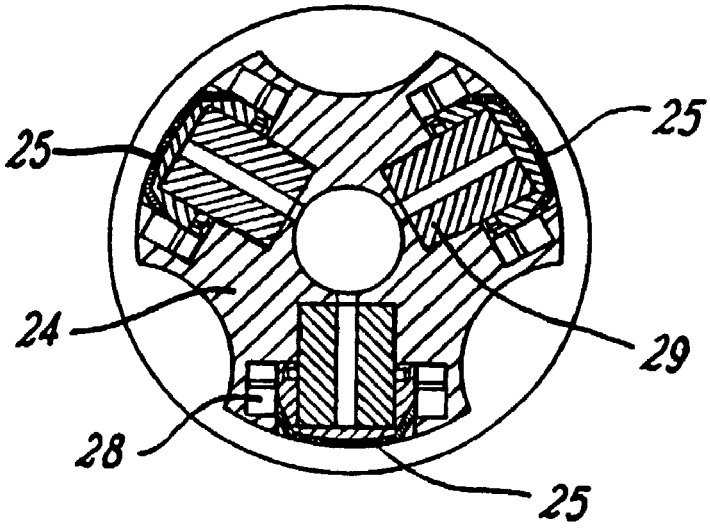
Figure 10:
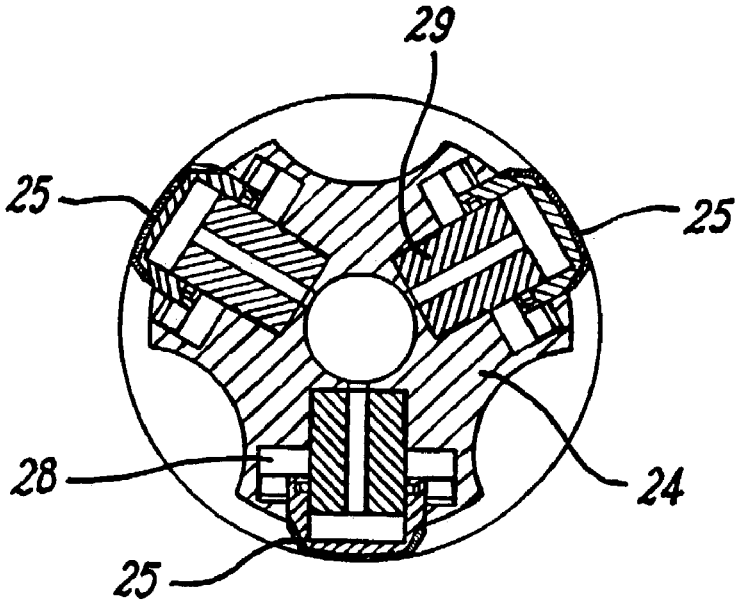
Figure 11:
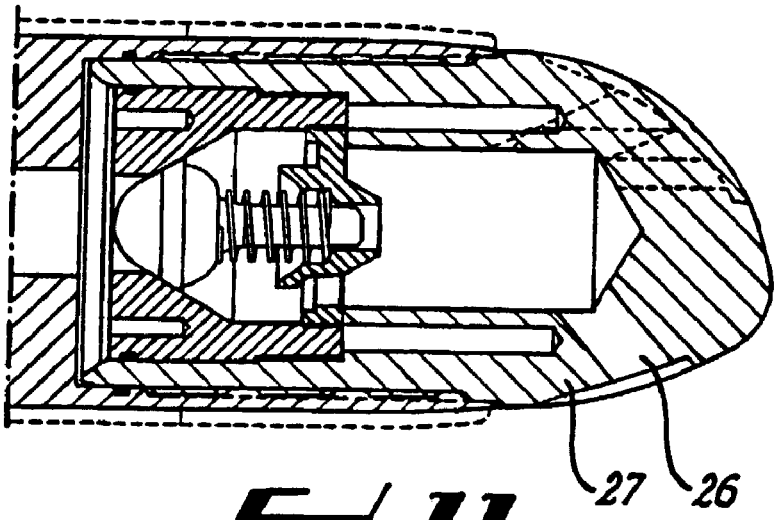
Figure 12:
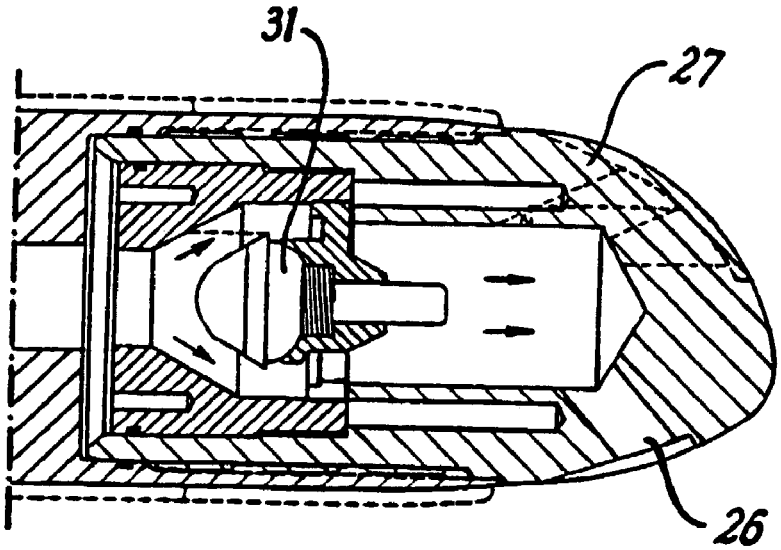
Figure 2:
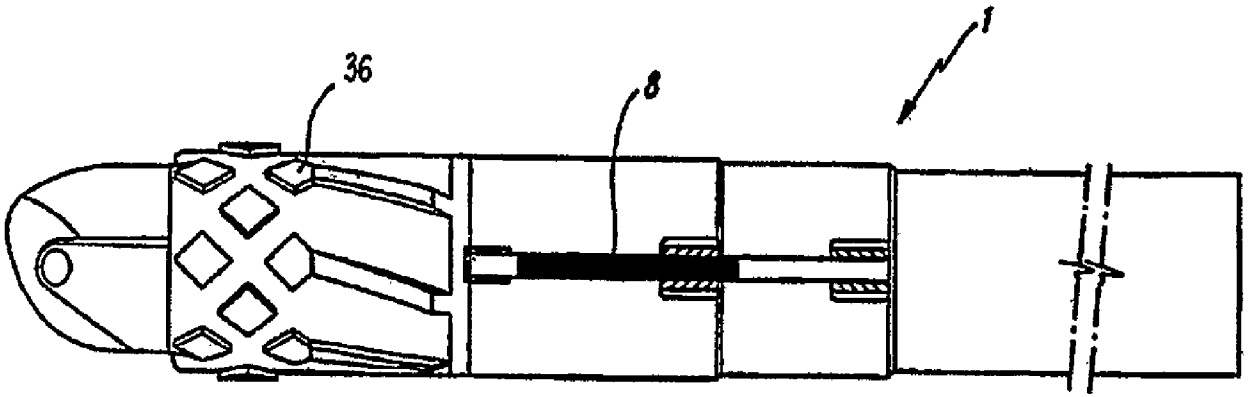

In order to provide a better understanding of the invention, an example first embodiment of the invention will now be illustrated with reference to the following Figures in which;

FIG. 1 illustrates a cross sectional view of an expandable reamer shoe in accordance with the present invention, FIG. 2 illustrates an external view of an expandable reamer shoe, FIGS. 3 and 4 illustrate embodiments of the grooves which co-operate with the split ring of the activating piston, in an alternative cross sectional view expandable reamer shoe, FIG. 5 illustrates the nose of an expandable reamer shoe with a float valve included, FIGS. 6 and 7 illustrate alternative retainer rings for use with of an expandable reamer shoe, FIG. 8 is a cross sectional view of an alternative second embodiment of an expandable reamer shoe, FIGS. 9 and 10 illustrate the nose of the expandable reamer shoe of FIG. 8 with a float valve option, and;

FIGS. 11 and 12 illustrate an alternative cross sectional view of the expandable reamer shoe of FIG. 8.

Referring firstly to FIG. 1, an expandable reamer shoe which can drift and ream a drilled section of well bore is generally depicted at 1 and is comprised of a cylindrical body (2) with an eccentric nose with ledge riding capability (3). The body (2) contains an activating piston (4) which is moveable and which defines an internal bore (5). The activating piston (4) has a split ring (6) which is fitted onto the outside diameter of the piston (4). The body (2) is made from steel and has hard facing reaming members (6) which can be seen in FIG. 2 applied to the leading end for reaming the inner most section of the drilled hole.

Upon assembly of the tool (1), the activating piston (4) with the split ring (6) mounted thereon will be inserted into the bore (5) of the body (2). Simple service tooling is used to install the split ring (6) into the bore (5) of the body (2). The piston (4) would be slid down to the position shown in FIG. 1B. A plurality of ramp segments (7) would then be welded onto the outside of the piston (4) through slots (8) in the wall of the body (2). The slots (8) can be seen in more detail on the external view of the reamer shoe (1) seen on FIG. 2.

It can be seen from FIGS. 3 and 4 that the piston (4) has six slots for the location of six ramp sections (7) each of which corresponds with one of six external blades (10). When the tool (1) is to be used as a reamer, the blades (10) have hard facing pre-applied, for example, hard or super hard metal or diamond. However when the tool (2) is to be used solely as a drift, the blades (10) will not need to have cutting grade hard facing. The piston (4), split ring (6) and ramp segments (7) are all made from a drillable material such as aluminium alloy. The blades (10) and body (2) are made from an material of medium hardness, such as alloy steel.

A deformable ball or dart (11) is then be dropped into the bore (5) of the piston (4). The ball or dart (11), which would typically be a rubber/plastic or rubber/plastic coated ball, can be seen in FIGS. 1A and 1B. A retainer ring (12) is then screwed into place, the retainer ring (12) also being made from a drillable material, such as aluminium alloy. The retainer ring (12) has holes (13) which allow fluid and mud to pass through the retainer ring (12) when tripping the shoe (1) to the bottom of the well bore. The eccentric nose (3) of the tool (1) may have hard facing (6) applied on the outside and may also have a float valve (14), as seen in FIG. 5. The eccentric nose (3) also has a bore which is large enough to accommodate the ball (11) and is typically off-centre to ensure that any subsequent drill bit (not shown) to be passed through the tool (1) can drill through the ball. This prevents the ball (11) from acting as a bearing upon which the drill bit will spin.

The assembly (1) can then be fitted onto the end of an expandable casing (not shown) and run into a pre-drilled well bore to the end of the section of well bore which has already been drilled and cased. At the end of the existing casing string, the tool (1) is activated just after the new casing enters the new drilled hole section, ie with the tool (1) in the rat hole below the existing casing. This is achieved by applying power to mud pumps (not shown), attached at the surface and to the top of the pipe used for running the expandable casing. The flow of mud in the first few seconds seats the ball (11) into the piston (4), if it is not already in this location. By applying static pressure thereafter, the ball (11) will seal off the piston bore (5) and pressure will be applied across the full area of the external seal on the piston (4). Thus the piston (4) is encouraged to move down the bore (5) of the body (2) of the tool and in doing so deforms the plurality of blades (10) outwards, by virtue of each of the blades (10) communicating with its corresponding ramp segment(7). When the piston (4) is moved down the bore (5) to the body (2), the ball (11) will rest in position in a seat (18) as shown in FIG. 1B. When the ball (11) rests on the seat (18) in the position seen in FIG. 1B, the piston (4) is stationary and the blades (10) are expanded to gauge size. In this position, the split ring (6) fits into a corresponding groove (15), which prevents the piston (4) from moving. The retainer ring (12) has seals (16) which are external to the retainer ring (12). The retainer ring (12) has two seals which fit into grooves (not shown) on the external surface of the retainer ring (12). When the seals (16) on the outside of the retainer ring (12) travel past corresponding holes or ports (17) in the body (2), there is a pressure drop at the surface which indicates that the blades (14) are at their gauge size.

By continuing to pump dynamically flowing fluid through the body (2) via the holes (17) to the outside, a dynamic pressure drop will be created. This will normally be lower than the static head which is required to push the piston (4) to this position. However on increasing the pump flow rate, the dynamic pressure head will be increased to a level above the static pressure head which is required to move the piston (4). As a consequence and at a pre-determined calculated level, the ball (11) will be pushed through the bore and the seat (18) of the piston (4) upon which the ball sits and into a seat in the eccentric nose (3). Mud can then flow through the nose (3). Rotation of the string can then take place and reaming to the bottom can commence.

FIG. 5 illustrates a float valve (14) which can be incorporated into the nose (3) of the tool (1). The float valve (14) allows mud and cement to pass through the nose (3) through the nozzles (19) in the nose (3) of the reamer shoe (1) to the bottom of the well, so that it can be displaced between the exterior surface of the casing and the interior surface of the well bore, to allow the casing to be cemented in place. However, the float valve (14) also ensures that cement cannot flow back into the reamer shoe through the nose although there would be some leakage through the pressure relief holes in the body adjacent to the retainer ring but the diametrical gap between the retainer ring and the body would be very small.

When reaming is completed, the nose (3), piston (4), split ring (6), ball (11) and retainer ring (12) and inside portion of the ramp segments can be drilled out with the drill bit (not shown), with a gauge diameter slightly smaller than the bore (5) of the body (2). The design of the ramp segments located in the wall of the body and welded to the piston prevents the piston and retainer ring spinning when being drilled out. The body (2) could also be expanded after drill out, by pushing a pig or plug from above the reamer shoe (1). Note that a seat for a hydraulic expansion seal dart could also be located in the reamer shoe including at the entry to the nose designed in this case so that the ball would still pass by or through it, with the ball seat in the guide end of the nose.

FIG. 4 illustrates one embodiment of the invention, which allows the blades (10) to be retracted after use, wherein each of the blades (10) is adapted to correspond with a ramp section (7) by a dovetail groove (20). The retainer ring (12) is provided with a profiled end which accommodates a retriever pulling tool (not shown), such as an overshot or spear. The retriever pulling tool can be used to pull the piston (4) back into its original position, hence pulling the blades (10) back into the body (2). FIG. 6 illustrates a retainer ring (12) which is adapted to suit a spear (21). FIG. 7 illustrates a retainer ring (12) which is adapted with an end to suit an overshot (22). It will be appreciated that de-latching of the overshot or spear will also be required in the event that it is desirable to pull back the casing string for any reason after reaming has commenced.

The tool (1) is designed to be welded while being assembled and manufactured, so that the amount of components within the internal bore (5) is minimised, and accordingly there are less internal parts which need to be drilled out for the next section of expandable casing.

The advantage of the above described embodiment lies in the fact that it is possible to drill through the expandable reamer shoe (1) after having reamed the expandable casing to the bottom, and following expansion and cementing of the expandable casing. However, it is also recognised in this invention that the reamer shoe (1) could be designed to act solely as a drift for the drilled hole or as a drift in addition to being a reamer shoe. Where the tool (1) is to be used as a drift, its dimensions are slightly smaller than that of the outside diameter of the drilled hole, and the tool will not comprise cutting grade hard facing. It is also recognised that the tool (1) could also be used with standard casing as opposed to expandable casing.

An alternative second embodiment of the reamer shoe is shown in FIG. 8, generally depicted at 23. The shoe (23) is made entirely from steel and is millable as opposed to drillable. The shoe (23) can also be retrieved back to the surface if required. The reamer shoe (23) can also be used with a final casing string, for example in a section which does not require drill-out.

The body (24) of the tool has three pockets each of which holds a blade (25) with hard metal or super hard metal or diamond, or other cutting grade material on the external surface, as shown in FIGS. 9 and 10. It will be appreciated that the cutting grade material will not be included on the blade (25) if the reamer shoe (23) is to be used as a drift only. The blades (25) are activated by the flow of fluid through the ports or nozzles (26) in the eccentric nose (27) of the tool (23) which creates a dynamic pressure drop between the inside and outside of the tool (23). This forces the blades (25) out against leaf springs (28) which are mounted in additional pockets along the length of the sides of the blades (25). Each blade (25) has a series of blade pistons (29) which are screwed into the base of the pockets of the body (24). The blades (25) are driven out to the gauge diameter by the dynamic pressure drop, against stop blocks (30) which are located at either end of each of the blades (25). The blades (25) are locked in place by the spring activated blocks (30), and reaming then commences to the bottom of the bore. A means to indicate that the blades (25) are at the gauge size could be achieved by adding a pressure relief valve (not shown). The leaf springs (28) hold the blades (25) into the body (24) when the tool (23) is tripped into the hole. FIG. 9 illustrates a cross section of the body (24) when the blades (25) are closed. FIG. 10 illustrates the same cross section of the body (24) when the blades are expanded.

If the tool (23) is to be used on the final string of casing, the tool can be left in-situ without being drilled out. In addition, a float valve (31) can be fitted to the eccentric nose (27) of the tool (23) to aid cementing. FIG. 11 illustrates the float valve (31) wherein the valve is closed thereby obturating the entry of fluid such as cement or mud from the body (24) of the tool (23) into the nose (27). FIG. 12 shows the float valve (31) when open, which allows fluid to flow into the nose (27) when reaming. If a float valve (31) is not fitted to the nose (27), the nose (27) can be made integrally with the body (24).

The casing can be retrieved at any time while reaming, by pulling the casing string uphole until the blades (25) bear against the end of the shoe of the last casing string, and by applying tension to the string from the surface. This will push the blades (25) into the body (24) by shearing the spring activated blocks (30). A bursting disk (32) may also be incorporated into the body (24) of the tool to increase the flow area through the tool for cementing. It is envisaged that a bursting disk (32) will be incorporated into the shoe (23) if the nozzles (26) of the nose (27) are small. Incorporation of the bursting disk will ensure that a reasonably high cross sectional flow area is available for cement to pass through. When using a burst disk it is likely that the nose will not incorporate a float valve as the cement could flow back in through the hole after the disc was burst. In this case the float valve would be fitted above the burst disc location.

An advantage of the present invention is that the reamer shoe can be expanded prior to the passage of expandable casing which will ensure that the casing can expand fully to the desired gauge size. A further advantage is that the reamer shoe may be drilled through by a subsequent drill bit or casing drill shoe with the first embodiment design. This allows further sections of a well-bore to be drilled below the region which has been lined by the expandable casing, without any damage to the drill bit. The expandable reamer shoe can also be advanced into the borehole by reciprocation and/or rotation.

Further modifications and improvements may be incorporated without departing from the scope of the invention herein intended.

The invention claimed is:

1. An expandable reamer shoe for mounting on a casing string, comprising:

a body upon which are arranged a plurality of reaming members, wherein:

said reamer shoe is substantially constructed from a relatively soft drillable material, the plurality of reaming members are moveable between a first and second position, the reaming members are closed in a first position and expanded in a second position, the reaming members are operable in the second position to remove a portion of a wellbore, wherein the reaming members move from the first position to the second position by virtue of an activating piston, and each of the reaming members has a hardened material applied to an outer surface.

2. An expandable reamer shoe as claimed in claim 1, wherein the plurality of reaming members are in the form of blades.

3. expandable reamer shoe as claimed in claim 1, wherein said activating piston defines an internal bore.

4. expandable reamer shoe as claimed in claim 1, wherein movement of the activating piston is provided by an increase in hydrostatic pressure.

5. An expandable reamer shoe as claimed in claim 4, wherein the increase in hydrostatic pressure is provided by an obstructing means within the internal bore of the activating piston.

6. An expandable reamer shoe as claimed in claim 5, wherein said obstructing means is a deformable ball or dart.

7. An expandable reamer shoe as claimed in claim 6, wherein the reaming members are fully expanded when the ball/dart communicates with a seat formation in the internal bore.

8. An expandable reamer shoe as claimed in claim 6, wherein the ball/dart is held inside the bore of the activating piston by a retainer ring.

9. An expandable reamer shoe as claimed in claim 8, wherein the retainer ring has a plurality of by-pass ports which allow fluid and mud to pass through the retainer ring.

10. An expandable reamer shoe as claimed in claim 8, wherein the retainer ring is adapted to receive a retrieval tool.

11. An expandable reamer shoe as claimed in claim 1, wherein the reamer shoe is adapted to receive a retrieval tool.

12. An expandable reamer shoe as claimed in claim 1, wherein the activating piston has an external split ring mounted around an outside diameter.

13. An expandable reamer shoe as claimed in claim 12, wherein the split ring can communicate with a groove in the body of the reamer shoe, wherein the activating piston is prevented from moving when the split ring is in communication with said groove.

14. An expandable reamer shoe as claimed in claim 1, wherein a plurality of ramps are located externally to the activating piston.

15. An expandable reamer shoe as claimed in claim 1, wherein the reaming members move from the first closed position to the second expanded position by virtue of a hydrodynamic pressure drop between an interior and exterior of the reamer shoe.

16. An expandable reamer shoe as claimed in claim 15, wherein said hydrodynamic pressure drop is created by one or more nozzles attached to a lowermost end of the reamer shoe.

17. An expandable reamer shoe as claimed in claim 1, wherein in the second expanded position the reaming members are locked in position by a first and a second retaining block at each respective end of each one of the reaming members.

18. An expandable reamer shoe as claimed in claim 1, wherein the expandable reamer shoe includes a cementing float valve.

19. The expandable reamer shoe of claim 1, wherein the reaming members are substantially coaxial with the body in both the first and second positions.

20. The expandable reamer shoe of claim 1, wherein the body has a nose portion having a substantially closed end.

21. The expandable reamer shoe of claim 1, wherein the reaming members are biased towards the first position.

22. The expandable reamer shoe of claim 1, further comprising an actuator for moving the one or more reaming members between the first position and the second position.

23. A method of inserting expandable casing into a borehole, comprising the steps of:

(a) running a first section of expandable casing into a pre-drilled borehole;

(b) expanding the first section of expandable casing in place;

(c) underreaming under the in-place first section of expanded casing using a standard underreamer and bit;

(d) running a second section of expandable casing through the first section of expandable casing with an expandable reamer shoe;

(e) reaming down the borehole by rotation and/or reciprocation of the expandable reamer shoe to an expected size; and (f) drilling through the expandable reamer shoe prior to running a subsequent section of expandable casing through an in-place section of expandable casing.

24. A method as claimed in claim 23, wherein the method includes the step of drifting the expandable reamer shoe.

25. A method as claimed in claim 23, wherein the method includes the step of expanding the second section of expandable casing into the reamed borehole.

26. A method as claimed in claim 23, wherein the method includes the step of cementing the expandable casing.

27. A method as claimed in claim 23, wherein the expandable reamer shoe is as claimed in claim 1.

28. A method as claimed in claim 23, wherein the method includes the step of expanding the body of the expandable reamer shoe.

29. A reamer shoe for mounting on a casing string, comprising:

one or more reaming members:

disposed on the body, radially movable from a retracted position to an extended position, and actuatable to remove a portion of the wellbore; and a locking member made from a drillable material and which locks the one or more reaming members in the extended position.

30. The reamer shoe of claim 29, further comprising a float valve.

31. The reamer shoe of claim 29, wherein the one or more reaming members comprises a blade.

32. The reamer shoe of claim 31, wherein each of the blades comprises a hard facing.

33. The reamer shoe of claim 29, further comprising an actuator for moving the one or more reaming members between the retracted position and the extended position.

34. The reamer shoe of claim 33, wherein the actuator comprises an activating piston.

35. The reamer shoe of claim 34, wherein movement of the activating piston is controlled by an increase in hydrostatic pressure.

36. The reamer shoe of claim 35, wherein the increase in hydrostatic pressure is provided by an obstructing member disposed within the activating piston.

37. The reamer shoe of claim 36, wherein the obstructing member comprises a deformable ball or dart.

38. The reamer shoe of claim 33, further comprising an obstructing member.

39. The reamer shoe of claim 38, wherein the obstructing member comprises a ball.

40. The reamer shoe of claim 39, wherein the one or more reaming members are retracted using a retrieval tool.

41. The reamer shoe of claim 38, further comprising a retainer ring for retaining the obstructing member inside the body.

42. The reamer shoe of claim 41, wherein the retainer ring includes at least one by-pass port to allow fluid flow pass the retainer ring.

43. The reamer shoe of claim 29, wherein the reamer is adapted to be retrievable.

44. The reamer shoe of claim 29, wherein movement of the one or more reaming members is controlled by an increase in hydrostatic pressure.

45. The reamer shoe of claim 29, further comprising a nose having one or more fluid passages, made from a drillable material, having a substantially closed end, and disposed on an end of the body.

46. The expandable reamer shoe of claim 29, wherein the one or more reaming members are biased towards the retracted position.

47. A method of inserting casing into a borehole, comprising:

running a first casing into the borehole;

running a second casing having an expandable reamer made from a drillable material into the borehole;

expanding the expandable reamer;

underreaming an uncased portion of the borehole using the expandable reamer; and coupling the second casing to the first casing.

48. The method of claim 47, further comprising drifting the expandable reamer.

49. The method of claim 47, further comprising expanding the second casing into the underreamed portion.

50. The method of claim 47, further comprising cementing the second casing.

51. The method of claim 47, wherein the expandable reamer is as claimed in claim 29.

52. The method of claim 47, further comprising drilling through the expandable reamer prior to running a subsequent casing through the second casing.

53. An expandable reamer shoe for mounting on a casing string, comprising:

a body upon which are arranged a plurality of reaming members, wherein:

said reamer shoe is substantially constructed from a relatively soft drillable material, the plurality of reaming members are moveable between a first position and a second position, the reaming members are closed in the first position and expanded in the second position, and in the second expanded position, the reaming members are locked in position by a first and a second retaining block at each respective end of each one of the reaming members.

54. An expandable reamer shoe for mounting on a casing string, comprising:

a body upon which are arranged a plurality of reaming members, wherein:

said reamer shoe is substantially constructed from a relatively soft drillable material, the plurality of reaming members are moveable between a first position and a second position, the reaming members are closed in the first position and expanded in the second position, the reaming members are operable in the second position to remove a portion of a wellbore, the reaming members move from the first closed position to the second expanded position by virtue of movement of an activating piston, and the activating piston has an external split ring mounted around an outside diameter.

55. An expandable reamer shoe as claimed in claim 54, wherein:

the split ring can communicate with a groove in the body of the reamer shoe, and the activating piston is prevented from moving when the split ring is in communication with said groove.

56. An expandable reamer shoe for mounting on a casing string, comprising:

a body upon which are arranged a plurality of reaming members, wherein:

said reamer shoe is substantially constructed from a relatively soft drillable material, the plurality of reaming members are moveable between a first position and a second position, the reaming members are closed in the first position and expanded in the second position, the reaming members are operable in the second position to remove a portion of a wellbore, the reaming members move from the first closed position to the second expanded position by virtue of movement of an activating piston, the reaming members move from the first closed position to the second expanded position by virtue of a hydrodynamic pressure drop between an interior and exterior of the reamer shoe, and said hydrodynamic pressure drop is created by one or more nozzles attached to a lowermost end of the reamer shoe.

57. An expandable reamer shoe for mounting on a casing string, comprising:

a body upon which are arranged a plurality of reaming members, wherein:

said reamer shoe is substantially constructed from a relatively soft drillable material, the plurality of reaming members are moveable between a first and second position, the reaming members are closed in a first position and expanded in a second position, the reaming members are operable in the second position to remove a portion of a wellbore, the reaming members are biased towards the first position.

58. An expandable reamer shoe as claimed in claim 57, wherein the reaming members are held in the first closed position by a plurality of leaf springs.

59. The expandable reamer shoe of claim 57, further comprising an actuator for moving the one or more reaming members between the first position and the second position.

60. The expandable reamer shoe of claim 57, further comprising an actuator for moving the one or more reaming members between the retracted position and the extended position.

61. A reamer shoe for mounting on a casing string, comprising:

a body;

one or more reaming members:

disposed on the body, radially movable from a retracted position to an extended position, wherein the one or more reaming members are biased towards the retracted position, and actuatable to remove a portion of the wellbore; and an actuator:

for moving the one or more reaming members between the retracted position and the extended position, and made from a drillable material.

62. The reamer shoe of claim 61, further comprising a nose: having one or more fluid passages, made from a drillable material, having a substantially closed end, and disposed on an end of the body.

63. An expandable reamer shoe for mounting on a casing string, comprising:

a body upon which are arranged a plurality of reaming members, wherein:

said reamer shoe is substantially constructed from a relatively soft drillable material, wherein the reamer shoe includes a rupture member which permits increased fluid flow from an interior of the reamer shoe to the exterior of the reamer shoe, the plurality of reaming members are moveable between a first and second position, the reaming members are closed in a first position and expanded in a second position, the reaming members are operable in the second position to remove a portion of a wellbore, and each of the reaming members has a hardened material applied to an outer surface.

wherein the reamer shoe includes a rupture member which permits increased fluid flow from an interior of the reamer shoe to the exterior of the reamer shoe.

64. A method of inserting a tubular into a wellbore, comprising the steps of:

running a section of expandable tubular into the wellbore with an expandable reamer shoe;

reaming down the borehole by rotation and/or reciprocation of the expanded expandable reamer shoe; and drilling through the expandable reamer shoe.

65. The method of claim 64, further comprising running a section of expandable casing into the wellbore prior to running the expandable tubular.

66. The method of claim 64, further comprising expanding the section of casing in place.

67. The method of claim 64, wherein the tubular is a casing.

* * * * *

UNITED STATES PATENT AND TRADEMARK OFFICE

CERTIFICATE OF CORRECTION

PATENT NO. : 7,100,713 B2
APPLICATION NO. : 10/258375
DATED : September 5, 2006
INVENTOR(S) : Rory McCrae Tulloch It is certified that error appears in the above-identified patent and that said Letters Patent is hereby corrected as shown below:

In the Drawings:

Please delete Sheet 2 of 7 and insert the attached Replacement Sheet 2 of 7.

In the Claims section:

In column 7, Claim 3, line 44, please insert --An-- before "expandable".

In column 7, Claim 4, line 46, please insert --An-- before "expandable".

In column 12, Claim 63, line 21, please delete the period "." after "surface" and insert a comma --,--.

Signed and Sealed this

Twenty-seventh Day of March, 2007

JON W. DUDAS
*Director of the United States Patent and Trademark Office*